US005732939A

United States Patent [19]

Meier

[11] Patent Number: 5,732,939

[45] Date of Patent: Mar. 31, 1998

[54] PROCESS FOR THE CONTINUOUS PRODUCTION OF DIFFERENT TYPES OF PRINTED PRODUCTS FROM DIFFERENT TYPES OF PRODUCT PARTS

[75] Inventor: Jacques Meier, Baretswil, Switzerland

[73] Assignee: Ferag AG, Hinwil, Switzerland

[21] Appl. No.: 509,119

[22] Filed: Jul. 31, 1995

[30] Foreign Application Priority Data

Aug. 17, 1994 [CH] Switzerland ..... 02-527/94

[51] Int. Cl.[6] ..... B65H 39/00

[52] U.S. Cl. ..... 270/52.01; 270/52.18; 270/52.2

[58] Field of Search ..... 270/52.01, 58.18, 270/58.19, 58.2

[56] References Cited

U.S. PATENT DOCUMENTS

| | | | |
|---|---|---|---|
| 1,766,117 | 6/1930 | Ellsworth | 270/52.19 |
| 4,073,510 | 2/1978 | Scharlin | 270/52.18 |
| 4,170,346 | 10/1979 | Murray et al. | 270/52.18 |
| 5,019,716 | 5/1991 | Meier et al. | 270/52.2 |
| 5,067,697 | 11/1991 | Hinegger | 270/52.28 |
| 5,106,068 | 4/1992 | Honegger | 270/58.01 |
| 5,267,821 | 12/1993 | Bodart et al. | 270/52.18 |
| 5,316,281 | 5/1994 | Bale et al. | 270/52.18 |
| 5,419,541 | 5/1995 | Stevens | 270/52.19 |
| 5,520,604 | 5/1996 | Reist | 493/422 |
| 5,608,639 | 3/1997 | Twaedowski et al. | 364/469.04 |

FOREIGN PATENT DOCUMENTS

| | | |
|---|---|---|
| 0 208 081 | 1/1987 | European Pat. Off. . |
| 0 511 159 | 10/1992 | European Pat. Off. . |
| 0 527 552 | 2/1993 | European Pat. Off. . |

*Primary Examiner*—John T. Kwon
*Attorney, Agent, or Firm*—Walter C. Farley

[57] ABSTRACT

A predetermined output sequence of miscellaneous printed products is produced by supplying a compilation or gathering station (80) with at least one continuous flow of individual, miscellaneous printed product parts in a supply (81 to 86), the individual, miscellaneous printed product parts in the flow being arranged in a preliminary sequence determined by the predetermined output sequence and the arrangement of the compilation station. At the compilation station (80) the printed product parts are compiled and then optionally joined together. The preliminary sequence of the at least one continuous supply flow is produced by timed, controlled take-overs of individual printed product parts from specific storage units (50) in a row of storage units, which are served by a group of successively arranged driving pins (60).

10 Claims, 5 Drawing Sheets

PROCESS FOR THE CONTINUOUS PRODUCTION OF DIFFERENT TYPES OF PRINTED PRODUCTS FROM DIFFERENT TYPES OF PRODUCT PARTS

FIELD OF THE INVENTION

The invention is in the field of the further processing of printed products and relates to a process for the continuous production of printed products from different printed product parts, i.e. for producing printed products such as e.g. magazines, brochures, etc., from different printed sheets or pages.

BACKGROUND OF THE INVENTION

According to the prior art printed products are produced from printed product parts, in that different product parts are gathered together or compiled and optionally interconnected. In the case of folded product parts (sheets), the compilation usually takes place by collecting the folded sheets on a saddle-shaped collecting element, which e.g. is moved past different supplies and at each supply a further sheet is opened and deposited on the saddle-shaped collecting element. When all the product parts of a product have been collected, they are e.g. centrally stitched together to form the finished product.

Product parts can also be compiled by insertion in a folded main product part, the product parts to be inserted being either folded or not folded. It is also possible to process the product parts by collating them into a stack and by subsequently joining in each case one edge of the parts, e.g. by gluing superimposed edges, so as to provide a finished product.

According to the prior art for high-performance processes for compiling product parts (collecting, inserting or collating), use is e.g. made of drums or rotary systems, which have a plurality of saddle-shaped collecting elements or a plurality of insertion compartments and which are equipped with supplies for the different product parts. With a production output of about 40,000 copies per hour, one type of printed product is produced with each of the products containing the same plurality of parts whereby a number as great as possible of these similar products is produced. Then the supplies are loaded with different types of product parts and printed products of a different type are produced, advantageously once again a maximum number of them. The resulting printed products are separately intermediately stored according to type and they are then, for dispatch purposes, optionally combined to form mixed dispatch units with random numbers of miscellaneous printed products.

It would represent a simplification of the miscellaneous printed products were so-to-speak simultaneously produced and immediately, i.e. without intermediate storage, moved away in the form of a predetermined sequence of products of different types directly from the production line, the output sequence of miscellaneous products e.g. corresponding to the compilation of the wanted dispatch units, i.e. representing a "post route-correct" output sequence. With the production of such a predetermined output sequence it would be possible to avoid the entire product handling associated with the intermediate or buffer storage.

With the above-described means for the production of printed products from different printed product parts the continuous production of a predetermined "post route-correct" output sequence becomes possible, if for each product type to be contained in the predetermined output sequence, there is a device for compiling product parts, e.g. a collecting and stitching drum and if the outlets from the different drums are guided by means of buffers to a joining station, at which by a correspondingly controlled removal of products from the different buffers the predetermined output sequence is produced. Such an arrangement permits the production of a predetermined output sequence of miscellaneous products, but the installation cost is very high and part of the installation, particularly in the case of product types with a very different demand, is only utilized to a very limited extent. However, the devices for producing each product type must be fully equipped for said production manner.

EP-511159 or U.S. Pat. No. 5,280,895 of the same applicant describes a process and an apparatus with which so-called individualized products are produced by gathering together different product parts and for high-performance production, use is once again made of a drum or a rotary system for compiling purposes. The process is essentially based on the fact that the supplies to the drum are so controllable that, as a function of the individual product to be produced, they are either added or not added corresponding to the product being produced. The so-called individualized products then essentially consist of a plurality of product parts, which are joined together in an unalterable sequence, but in said sequence individual product parts or even complete groups of product parts can be missing.

If a device similar to or as described in EP-511159 or U.S. Pat. No. 5,280,895 is made of corresponding length, i.e. equipped with a corresponding number of supplies, it is possible to produce therewith a predetermined "post route-correct" output sequence of miscellaneous products, in that in each case one group of supplies is provided for the product parts belonging to a particular product type and in that for the production of a specific product in the sequence only the supplies delivering the product parts necessary for the specific product are active, whereas no product part is supplied by the other supplies in the corresponding cycles. Such an arrangement also permits an additional individualizing of the products to be produced, as is described in the publication, the control remaining relatively simple, because the entire system is dependent on a single system time cycle.

Compared with the first mentioned system having a complete production device for each product type occurring in the predetermined output sequence, the system with the extension of the gathering section leads to the advantage that, through a corresponding choice of the sequence of the supplies several supplies for the same product part, which occurs in several of the product types, can be avoided.

However, both the described, known systems essentially suffer from the same disadvantage, namely a space and investment-intensive installation, which is at least partly poorly utilized.

SUMMARY OF THE INVENTION

An object of the invention is to provide a process making it possible to produce in a continuous manner a predetermined output sequence of different types or miscellaneous printed products by compiling (collecting, inserting or collating) in each case a plurality of different product parts. The different product types can differ by the number and by the nature of the product parts, but can at least partly have the same product parts optionally in different places or in a different order. The complete process must be subjectable to a unitary process timing cycle. The process according to the invention must make it possible to largely use those devices which are known and have proved themselves in the further processing of printed products. The entire installation for performing the process according to the invention must require less space and the devices used must be better utilized than in the known systems for solving the set problem discussed above. It must also be simple to extend the process of the invention in such a way that the printed products of the predetermined output sequence are not only of different types, but also individualizable, i.e. can be provided in accordance with an addressing sequence with individual inscriptions and/or product parts. However, conversely it must also be easily possible to so simplify the system according to the invention that only printed products (individualized or non-individualized) of one particular type can be produced therewith.

The process according to the invention essentially consists of two steps. In a first step at least one substantially continuous supply flow of individual, different printed product parts is produced. This at least one supply flow of printed product parts is continuously supplied to a second process step, namely the compiling of in each case a plurality of printed product parts. This can be followed by a third step, in which the compiled printed product parts are e.g. joined together by stitching or adhesion. The at least one supply flow of individual, different printed product parts produced in the first process step contains the different printed product parts in a preliminary sequence, which is defined by the predetermined output sequence and by the design of the second process step.

The at least one supply flow of individual, different printed product parts is produced so that supply units, which in each case contain a plurality of printed product parts of the same type; are prepared in a row, so that a plurality of successive driving pins in the conveying direction are guided parallel to the said row and from one end of the row to a compilation section or station and so that the driving pins and/or corresponding removal devices associated with the supply units are controlled in such a way that in timed manner and in accordance with the necessary preliminary sequence, individual printed product parts are conveyed away from the supply units by the driving pins and are supplied to the compilation station in the necessary preliminary sequence.

The difference between the process according to the invention and the above described, known process for producing a predetermined output sequence of miscellaneous printed products is that in the process according to the invention the product parts are arranged in a preliminary sequence corresponding to the output sequence, whereas in the known process only the finished products (compiling device for each product type) are arranged to the output sequence or the production of the output sequence takes place during compilation (compiling device with a corresponding number of supplies).

BRIEF DESCRIPTION OF THE DRAWINGS

The process according to the invention is described in greater detail hereinafter with reference to various embodiments illustrated in the attached drawings, wherein.

DESCRIPTION OF THE PREFERRED EMBODIMENTS

Figure 1A:
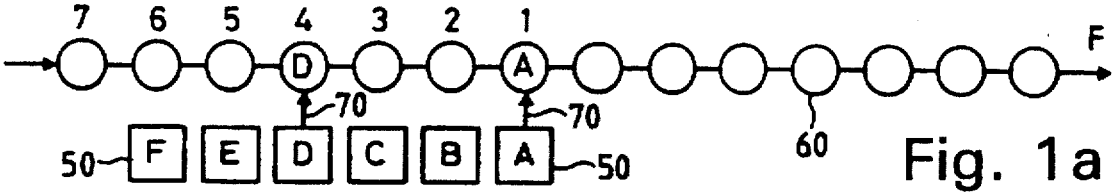
FIGS. 1A through 1*g* shows a diagram of the first process step for producing a continuous supply flow consisting of individual, miscellaneous printed product parts in a predetermined preliminary sequence.
Figure 1B:
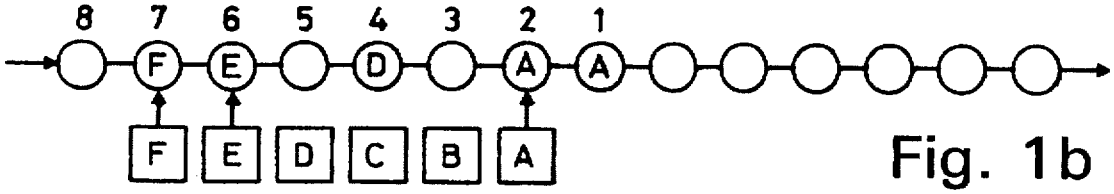
Figure 1C:
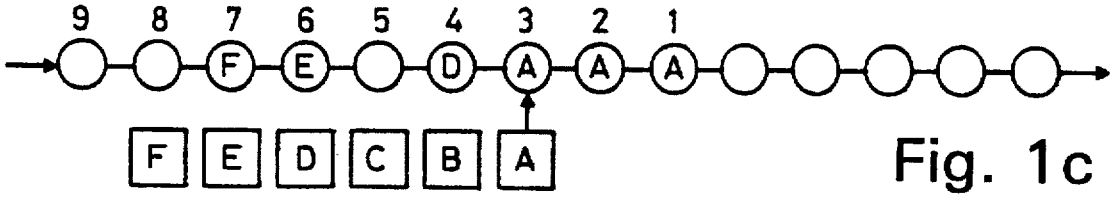
Figure 1D:
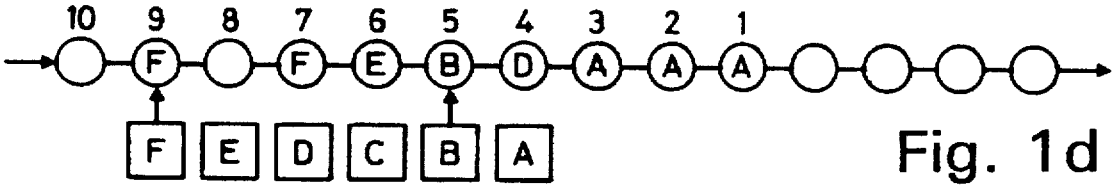
Figure 1E:
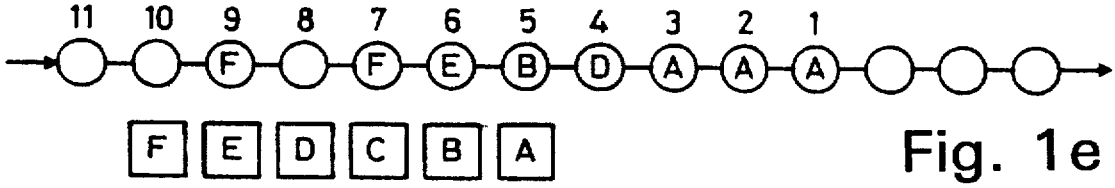
Figure 1F:
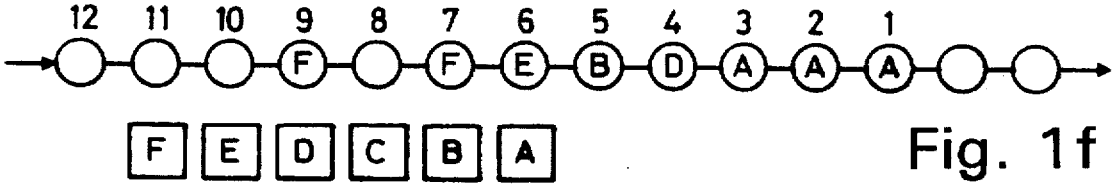
Figure 1G:
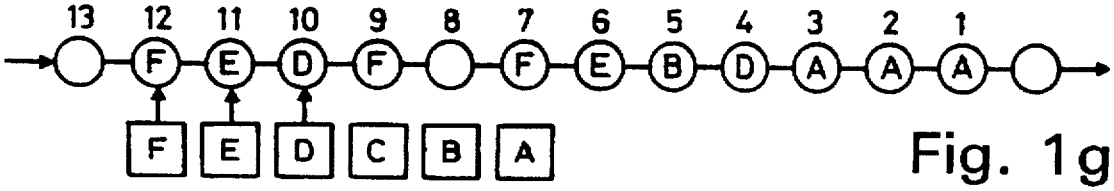

FIGS. 1*a*–1*g* diagrammatically shows the sequence of the first process step of the process according to the invention consisting of producing, from miscellaneous product parts (sheets, pages, etc.), a substantially continuous supply flow of individual, miscellaneous product parts in a necessary preliminary sequence. In seven phases, FIGS. 1*a*–1*g* show the production of the preliminary sequence of product parts A-A-A-D-B-E-F-/-F-D-E-F from six storage units for product parts of types A, B, C, D, E and F (/designates a gap in the sequence). Between in each case two neighboring phases a to g there are always identical times, so that the phases represent a clock sequence.

The storage units 50 for in each case one type A to F of product parts are arranged in a freely selectable order in a row. Driving pins 60, arranged successively and equidistantly in the conveying direction F, are so conveyed parallel to said row of storage units, that they assume in timed manner positions in such a way that, in each cycle from each storage unit 50, one product part may be taken by, in each case, one driving pin 60 (arrow 70). In the manner shown in FIG. 1, this can e.g. be implemented in that between the storage units 50 the same spacings are provided as between the driving pins 60, a timing cycle corresponding to the time needed by a pin in order to be conveyed over this spacing or distance. However, it is also possible for the spacings between the storage units 50 to represent an integral multiple of the spacings between the driving pins 60. The spacings between the individual storage units 50 need not be identical.

After passing the row of storage units 50, the driving pins 60 are conveyed to a supply station of a compilation or gathering station or section and from there are advantageously moved back again to the start of the row of storage units, which is not shown in FIG. 1. The driving pins 60 are arbitrarily numbered with consecutive numbers starting from the furthest forward storage unit in the conveying direction.

For producing the preliminary sequence the timed take-overs or acceptances of individual printed product parts by driving pins are controlled in such a way that a take-over or acceptance always occurs if a pin is located in the vicinity of the particular storage unit from which it is to take over a product part in accordance with the preliminary sequence and in one cycle there are at the most as many take-overs as there are storage units, or less. In the represented case of producing the preliminary sequence A-A-A-D-B-E-F-/-F-D-E-F this e.g. applies for driving pins 1 and 4 in cycle a, for driving pins 2, 6 and 7 in cycle b, etc. For controlling the takeovers the driving pins and/or removal means associated with the storage units are controlled.

It is obviously also possible in a preliminary sequence to provide gaps, as is represented at the eighth position (-/-) of the preliminary sequence in FIG. 1.

The devices for performing the first process step are e.g. endless chains with controllable grippers equidistantly fixed thereto and stack-like storage units arranged in the vicinity of the grippers. For the taking over of a printed product part a gripper grips a printed product part from the corresponding stack, said part having advantageously beforehand been at least partly separated from the stack by a removal means associated with the storage unit.

It is also conceivable to have compartments arranged in the form of a row, which are moved past and under stackable storage units, for the purpose of performing the first process step. For the take-over from the bottom of the stack is then separated a printed product part and it drops by gravity, advantageously in a suitably guided manner, into a compartment.

The supply flow of different printed product parts with a predetermined preliminary sequence produced according to the description referring to FIGS. 1*a*–1*g* is then, according to the invention, supplied to a compiling step. This compiling station can follow directly after the downstream, furthest forward storage unit in such a way that a driving pin in one cycle passes into the vicinity of said furthest forward storage unit and in the next cycle transfers its product part into the compilation or gathering station. However, between the furthest forward storage unit and the supply into the gathering station there can also be a conveying station with a length corresponding to a random number of complete cycles.

Figure 2:
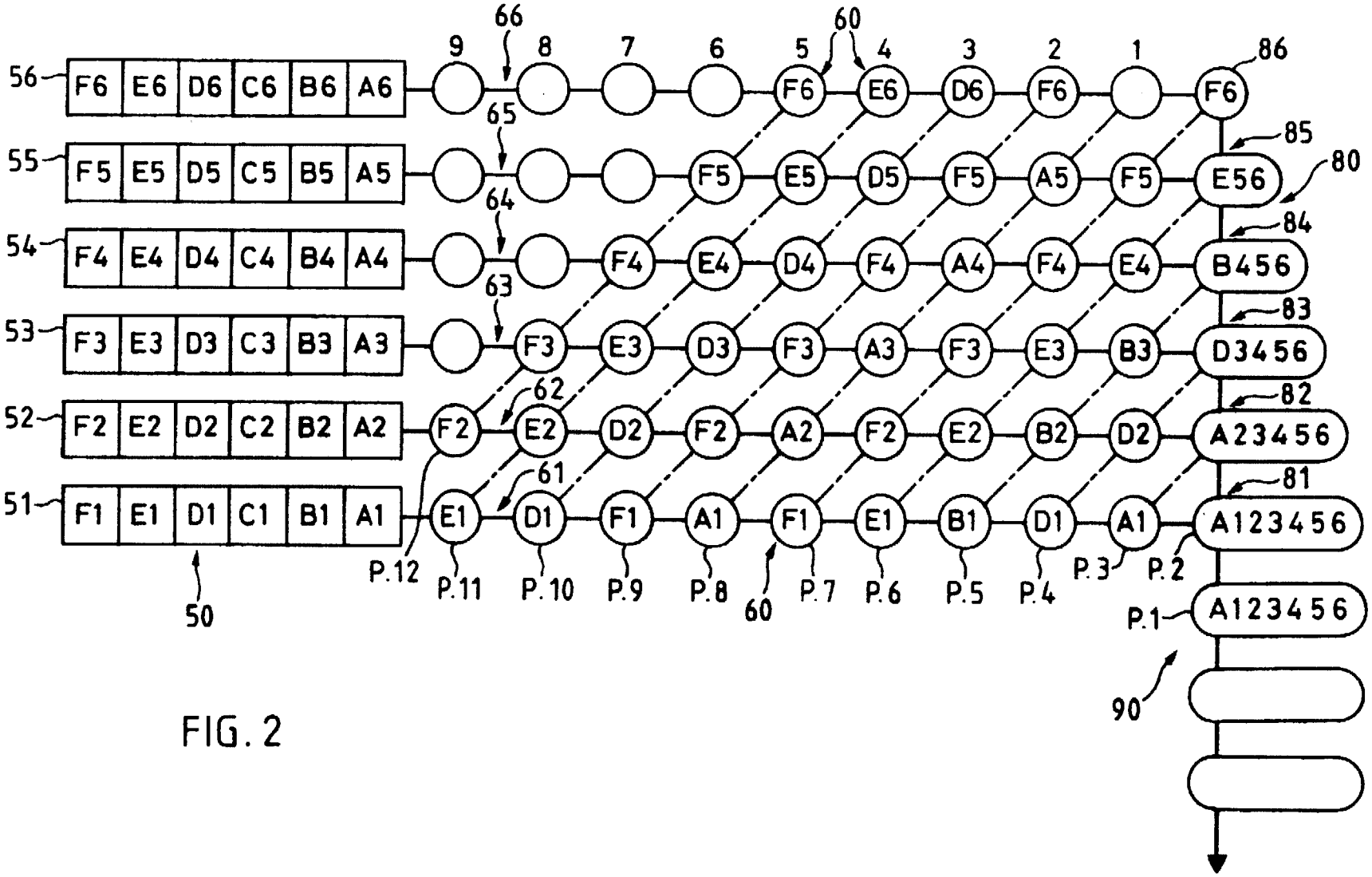
FIG. 2 shows an exemplified process variant of the process according to the invention with six supply flows of miscellaneous product parts for producing a predetermined output sequence of miscellaneous products, in each case consisting of a maximum of six product parts.

FIG. 2 shows an of the process according to the invention for producing a predetermined output sequence of six different product types A to F, each product comprising six product parts (A1 to A6, B1 to B6, etc.) or a maximum of six product parts.

FIG. 2 shows six rows 51 to 56 of storage units 50 from which by means of six groups 61 to 66 of driving pins 60 product parts are conveyed to six supplies 81 to 86 of a compiling station 80, namely in a preliminary sequence produced in the manner described in conjunction with FIG. 1. In order to simplify the drawing the storage units 50 are shown as simply connecting onto the conveying paths of the driving pins 60. Each of the preliminary sequences supplied to the six supplies consists of those product parts of each product type, which in the sequence or order of the product parts in the finished product assume the same position. For collected product parts this e.g. means that the pin group 61 supplies product parts A1 to F1, which represent the outermost parts of the finished products, whereas row 66 supplies the innermost parts A6 to F6.

An typical output sequence of products P.1 to P.11 of product types A to F (A123456 to F1234356) to be produced by the process according to FIG. 2 is (based on the sequence in FIG. 1) A-A-A-D-B-E-F-A-F-D-E-F. The preliminary sequences necessary for the supplies are calculated from the predetermined output sequence and from the position of the corresponding supply in the compiling station. The number of the clock cycle in which a product part must be supplied is obtained by subtracting the distance (in cycles) between the corresponding supply station and the outlet of the compiling station from the cycle number of the outlet of the corresponding, finished product. For example, the first product P.1 (A123456) of the output sequence passes out of the outlet 90 of the gathering station in the cycle x. Then, e.g. for said product P.1 the product part A6 must be supplied by the driving pin group 66 in the cycle x–6. For the fourth product P.4 (D123456) of the output sequence, which is to pass out in the cycle x+3, the corresponding product part D6 must be supplied in the cycle x–3.

The product parts of potential products are joined together by the dot-dash lines in the preliminary sequences shown in FIG. 2 to the different supplies.

The numbers of the cycles in which specific product parts are taken over from storage units by the driving pins (take-over cycles) are calculated by subtracting the spacing (in cycles) between the particular storage unit of the supply station from the number of the supply cycle or by subtracting the spacing (in cycles) between the storage unit and the outlet from the number of the outlet cycle. The storage units of the product parts A6 or D6 are removed by 10 or 13 cycles from the supply 86, which is 6 cycles away from the outlet 90. The aforementioned product parts A6 of product P.1 (A123456, outlet cycle x) or D6 of product P.4 (D123456, outlet cycle x+3) are consequently taken over in the cycles x–6–10 (or x–16) or x–3–13 (or x+3–19), i.e. both in the cycle x–16 by the driving pins. This cycle (x–16) is obviously represented as cycle a in FIG. 1, whereas FIG. 2 is a representation of the cycle X.

At the outlet 90 of the compiling or gathering station 80 is provided the predetermined output sequence of products, one product being ejected per cycle.

If the product types consist of less than the maximum possible, e.g. six product parts, the corresponding storage units are not supplied. An individualizing of the products is possible in a process according to FIG. 2 to the extent that in certain products certain product parts can be missing (e.g. product part A6 in product P.8, which in FIG. 1 corresponds to the gap in the preliminary sequence). For such an individualization no additional control is needed. For the driving pin 1 of the group 66 simply no transfer is included in the control for the product P.8.

The production of products A123456 to F123456 is an example of use of the process variant shown in FIG. 2 and for this production the same preliminary sequence is produced for each supply, merely displaced by one to six cycles. Obviously by producing different preliminary sequences for the individual supplies the same process variant can also produce mixed products, i.e. products having product parts of different types (A to F).

Figure 3:
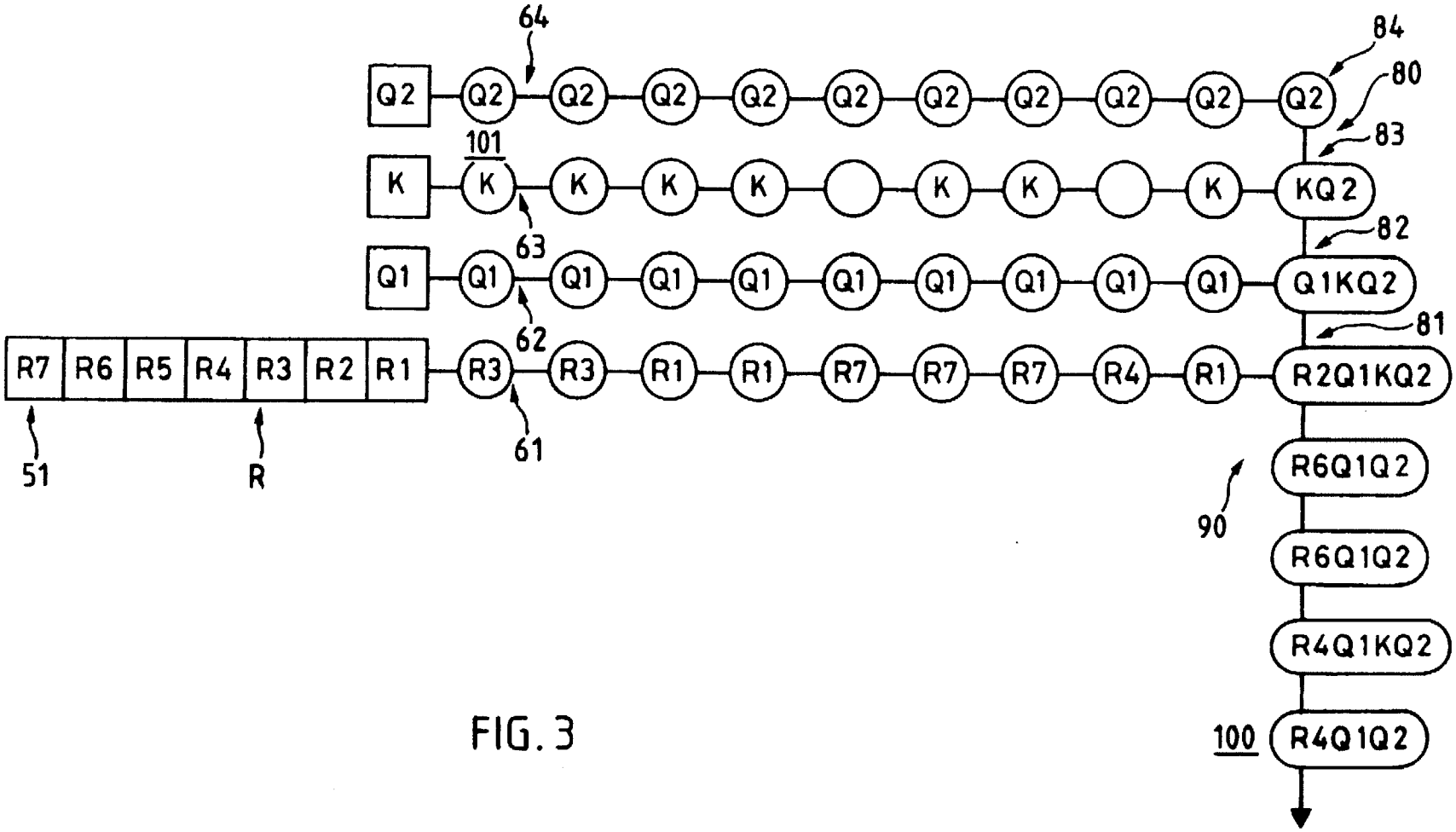
FIG. 3 shows a further exemplified process variant of the process according to the invention with a supply flow of different product parts for producing a predetermined output sequence e.g. of regionalized and individualized printed products.

FIG. 3 shows another variant of the process according to the invention for producing products regionalized by corresponding cover sheets and individualized by the presence or absence of an insert or supplement. The process once again has compiling station 80, e.g. in the form of a collecting drum. The compiling station has four supplies 81 to 84 to which are supplied product parts by groups 61 to 64 of driving pins. Only the supply 81 is supplied in a preliminary sequence with a supply flow of individual, different product parts R1 to R7 (e.g. regionalized cover sheets), which is produced in that, as described relative to FIGS. 1*a*–1*g*, the group 61 of driving pins is guided for a controlled take-over along the row 51 of storage units of the product parts R1 to R7. In known manner to the supplies 82 and 84 are supplied similar product parts (Q1 and Q2) and to the supply 83, in controlled manner, a supplement K, which is or is not added as a function of the product (address). The output sequence of the process as represented in FIG. 3 comprises products, which all have the inner sheets Q1 and Q2, which are regionalized by the corresponding cover sheet R and individualized by a supplement, which can also be omitted.

The products produced in the process according to FIG. 3 can e.g. be individually addressed at station 100. The supplements K can also be further individualized with the same address or a message associated with the address, in that said message is correspondingly inscribed at a point 101, which is 15 cycles from the addressing point 100, 15 cycles earlier than the addressing.

Figure 4:
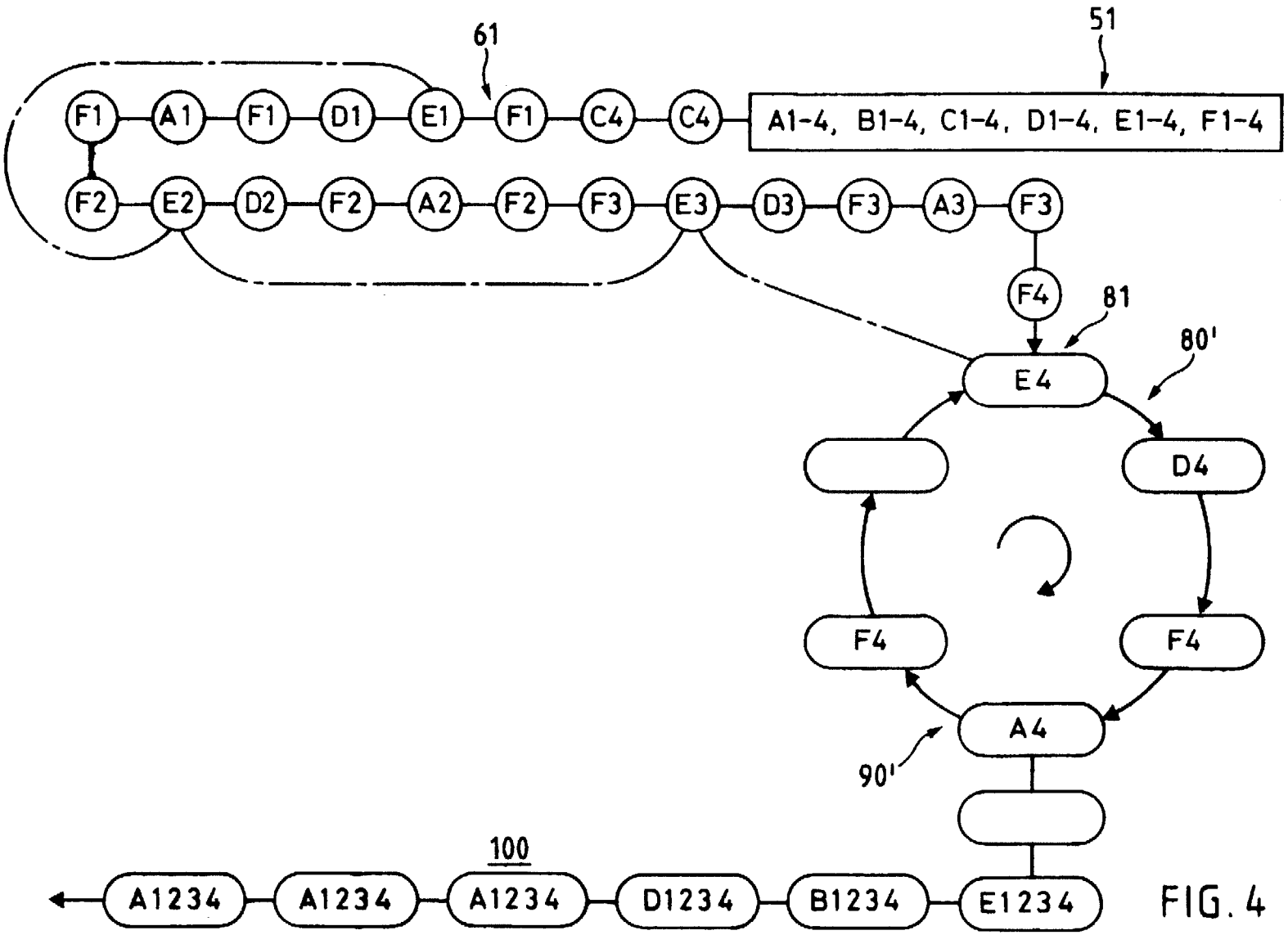
FIG. 4 shows a further process variant of the process according to the invention with a supply flow of different printed product parts and with the return of the resulting products to the supply for producing an output sequence of random products.

FIG. 4 shows a further variant for the process according to the invention for producing a predetermined output sequence of products produced by compiling in each case a plurality of different product parts. In this process variant only one necessary preliminary sequence, produced according to the first process step (FIGS. 1*a*–1*g*), is supplied to a compiling step, the products being produced in the compiling step being returned several times to the supply. During each return a further product part is added. When a product has the necessary number of printed product parts, it is discharged from the compiling step at an outlet.

For performing the process once again there is a row 51 of storage units and a group 61 of driving pins serving said row. The driving pins convey product parts to a supply 81 of a compiling station 80', which is closed and has as an outlet 90' an outlet deflector. The storage unit row 51 consists of storage units for all the product parts of all the product types, which occur in the predetermined output sequence. The product parts are compiled to form products, in that the resulting product is returned to the supply the number of times necessary for it to have all the required parts. The parts belonging to an individual single product are removed from one another in the preliminary sequence by the same clock number as is necessary for a revolution on the compiling station.

The number of the take-over cycle for a given product part is calculated by subtracting the distance (in cycles) between the supply and the outlet and the distance (in cycles) between the supply and the storage unit and a circumference of the gathering station (in cycles) for each further part from the number of the output cycle. In the drawing the product parts of the eleventh product of the output sequence (E1234), which has just passed the supply for the second time, are linked by a dot-dash line.

FIG. 4 illustrates the production of an output sequence A-A-A-D-B-E-F-A-F-D-E-F, each product consisting of four product parts (A1 to A4, B1 to B4, etc.). In a clock numbering such that the first product of the sequence is to appear at the outlet 90' in the cycle x, the drawing is a representation of cycle x+7. It is clear that with a process according to FIG. 4 a product cannot be ejected in each cycle. In the cycles x+6 to x+25 (in which the part of the output sequence from the seventh to the twelfth product F-A-F-D-E-F is completed and conveyed to the outlet), no products are ejected. The average capacity of the process variant with a single supply is dependent on the number of product parts in the products and is one product per number of cycles, which corresponds to the average number of product parts per product.

The advantage of the process of FIG. 4 is that with only a single storage unit per type of product part, a random output sequence of products can be produced with a random number of product parts, with random numbers of identical product parts and with a random order of the product parts. In this process variant it is also possible following the outlet 90° from the process section, to individually inscribe, e.g. address the products in a corresponding station 100.

Figure 5:
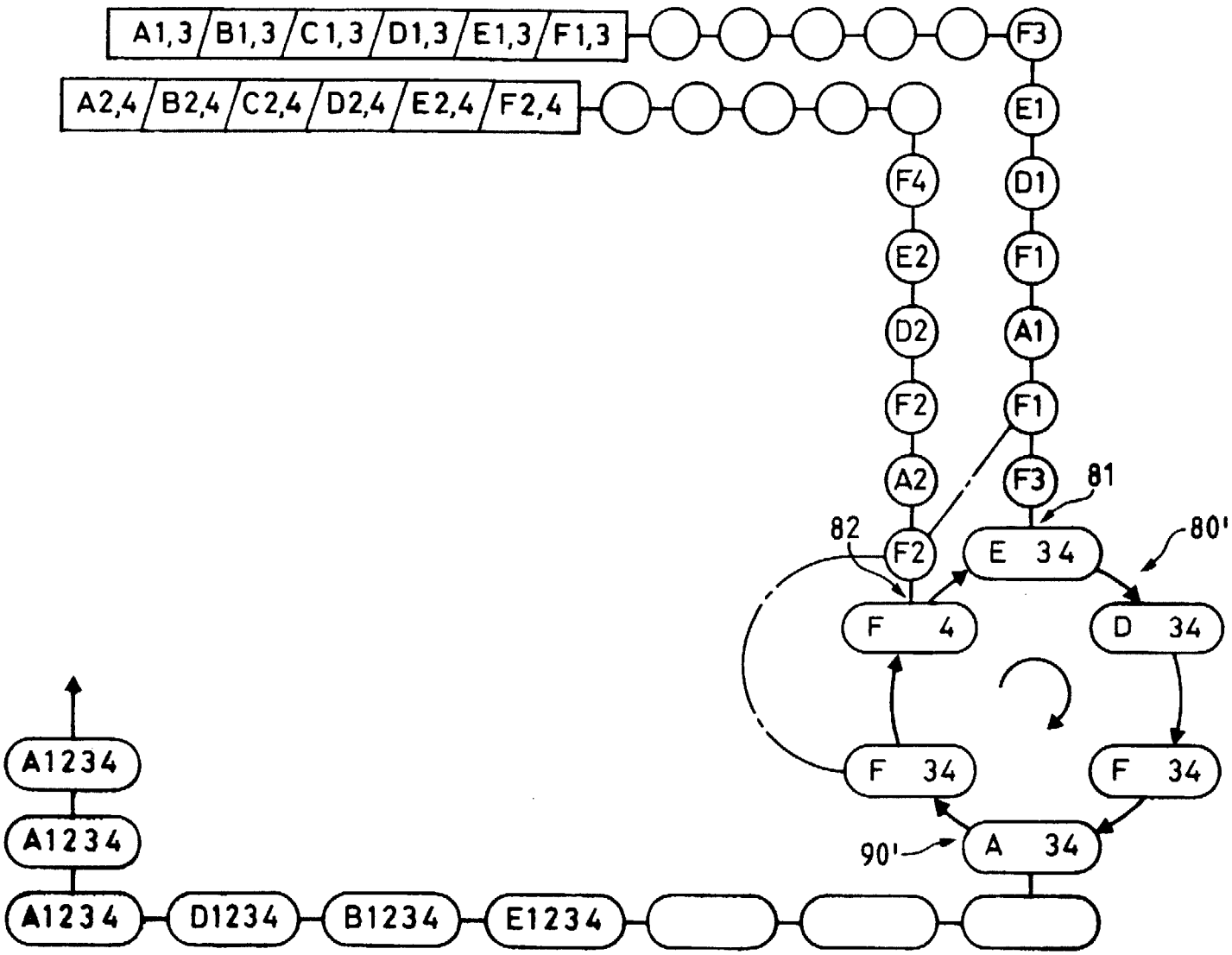
FIG. 5 shows a further process variant of the process according to the invention, like the variant of FIG. 4, but with two supply flows of different printed product parts.

FIG. 5 shows an extension of the process according to FIG. 4, so that there are two supplies for a closed compiling station. This process variant makes it possible for the same output sequence to eject twice as many products per cycle as in the variant of FIG. 4. The production example shown in FIG. 5 relates to the same output sequence (A-A-A-D-B-E-F-A-F-D-E-F) as in FIG. 4. A comparison of the two drawings shows that the necessary product parts must in each case be alternately supplied to the two supplies 81 and 82, i.e. A1 and A3 to F1 and F3 to supply 81 and A2 and A4 to F2 and F4 to supply 82. In all other ways the remarks made in conjunction with the other drawings also apply to FIG. 5, so that there is no need for any further description thereof.

By combining the process variants of FIG. 2 and FIGS. 4 or 5, a variant is conceivable with a closed compiling station, which has as many supplies as the bulk of products of the output sequence have product parts. Thus, most of the products pass through the compiling station only once and a second passage only has to be provided for the few products which have more product parts than there are supplies. It is also conceivable to combine a closed compiling station with a further compiling station connecting on to its outlet. With such variants of the process according to the invention the necessary devices, also in the case of a very widely differing occurrence of product types in the predetermined output sequence are still very uniformly utilized.

I claim:

1. A method for producing a predetermined sequence of printed products wherein each printed product of the sequence has a different number of product parts selected from a variety of available product part types, the method comprising the steps of providing a stock of product parts including each type of the variety, arranging product parts selected from the stock of different product part types in at least one supply stream in a predetermined supply sequence, supplying continuously the at least one supply stream of product parts to a compiling station, and at the compiling station, compiling the product parts in the sequence in which the parts are supplied in the stream, the supply sequence being predetermined by the desired sequence of products to be produced and by the operating sequence of the compiling station.

2. A method according to claim 1 wherein the step of providing a stock of product parts includes a row of storage units, each unit containing a plurality of product parts of one type of the variety, and wherein the step of arranging includes moving a conveying apparatus past the row of storage units and taking from the storage units selected product parts in the predetermined supply sequence.

3. A method according to claim 1 wherein the step of arranging includes arranging product parts in a plurality of supply streams, wherein the plurality of supply streams are provided to the compiling station, and wherein, at the compiling station, each product is produced by successively receiving product parts from the plurality of supply streams.

4. A method according to claim 3 wherein products being formed are conveyed in a substantially closed loop, receiving product parts from the plurality of supply streams delivering product parts to the loop, and wherein a product being formed receives product parts at a junction of a supply stream and the loop a plurality of times.

5. A method according to claim 3 wherein products being formed are conveyed in a conveying direction along a path in a substantially closed loop having an exit, the products being formed receiving product parts from the plurality of supply streams delivering product parts to locations spaced along the loop, and wherein the compiling station further includes at least one supply stream delivering product parts to a location beyond the loop in the conveying direction.

6. A method according to claim 1 wherein the product parts are folded, and wherein the step of compiling comprises collecting and superimposing folded product parts on the product being formed with the folds of the product parts facing upwardly.

7. A method according to claim 1 wherein the product parts are folded, and wherein the step of compiling comprises inserting and superimposing folded product parts on the product being formed with the folds of the product parts facing downwardly.

8. A method according to claim 1 wherein selected ones of the supply streams provide product parts of one type only.

9. A method according to claim 1 and further comprising, after the step of compiling, the step of printing on compiled products data unique to each product.

10. A method according to claim 1 and further comprising, after the step of compiling, joining the product parts of each product by stitching or gluing.

* * * * *